US006035967A

United States Patent [19]

Maeda

[11] Patent Number: 6,035,967

[45] Date of Patent: Mar. 14, 2000

[54] SAFETY APPARATUS USING PARALLEL LINE CATCHERS FOR ELEVATED WORK SITE OPERATIONS

[76] Inventor: Hiroshi Maeda, 26-2, Suberiiwahama, Ookuwajima, Muya-cho, Naruto-shi Tokushima, Japan, 772

[21] Appl. No.: 08/986,561

[22] Filed: Dec. 8, 1997

Related U.S. Application Data

[63] Continuation-in-part of application No. 08/551,609, Nov. 1, 1995, abandoned.

[51] Int. Cl.[7] ..... E04G 21/32

[52] U.S. Cl. ..... 182/138

[58] Field of Search ..... 182/138, 139; 248/65.1

[56] References Cited

U.S. PATENT DOCUMENTS

| | | | |
|---|---|---|---|
| 1,048,946 | 12/1912 | Corley . | |
| 1,134,850 | 4/1915 | Hebert | 211/119.1 |
| 1,144,544 | 6/1915 | Hicks . | |
| 1,188,071 | 6/1916 | Hayes . | |
| 1,281,475 | 10/1918 | Anderson | 211/119.1 |
| 1,546,399 | 7/1925 | Moylan . | |
| 1,896,996 | 2/1933 | Beglinger | 211/119.1 |
| 2,040,746 | 5/1936 | Kniedler | 211/119.1 |
| 2,360,458 | 10/1944 | Wentz | 211/119.1 |
| 3,077,149 | 2/1963 | Eckel | 182/139 |
| 4,119,176 | 10/1978 | Verdu | 182/138 |
| 4,162,063 | 7/1979 | Nissen et al. . | |
| 4,475,628 | 10/1984 | Heilskov . | |
| 4,660,790 | 4/1987 | Muz | 248/68.1 |
| 4,732,234 | 3/1988 | Brickman . | |
| 4,892,169 | 1/1990 | Duncan . | |
| 4,982,813 | 1/1991 | Starr . | |
| 4,986,389 | 1/1991 | Halligan, Sr. et al. . | |
| 5,029,782 | 7/1991 | Andre . | |
| 5,161,641 | 11/1992 | Nusbaum . | |
| 5,723,819 | 3/1998 | Kirma . | |

FOREIGN PATENT DOCUMENTS

| | | |
|---|---|---|
| 59-57656 | 4/1984 | Japan . |
| 63-65790 | 12/1988 | Japan . |
| 4-116544 | 10/1992 | Japan . |

*Primary Examiner*—Alvin Chin-Shue
*Attorney, Agent, or Firm*—Weneroth, Lind & Ponack, L.L.P.

[57] ABSTRACT

The safety apparatus using nets for elevated work site operations uses parallel line catchers for catching falling workers. Each space between two adjacent lines of a parallel line catcher can be widened opening an area for passing building materials such as boards therethrough by moving the lines outwardly. Therefore, even though falling workers can be caught, construction materials can be freely passed through the catchers.

5 Claims, 20 Drawing Sheets

SAFETY APPARATUS USING PARALLEL LINE CATCHERS FOR ELEVATED WORK SITE OPERATIONS

This is a continuation-in-part of U.S. patent application Ser. No. 08/551,609, filed on Nov. 1, 1995 abandoned.

This application is based on application No. 9-275170 filed in Japan on Sep. 22, 1997, the content of which is incorporated hereinto by reference. The entire disclosure of U.S. patent application Ser. No. 08/551,609 is also incorporated herein by reference.

FIELD OF THE INVENTION

The present invention generally relates to a safety apparatus for elevated work site operations wherein safety is improved by using nets (more accurately parallel line catchers) to catch workers who fall from high places. More particularly, the present invention comprises a pair of spaced apart support members, and a plurality of elongated lines supported by and extending between the spaced apart support members in a substantially longitudinal direction. The elongated lines are disposed parallel to one another and are spaced apart from one another in a transverse direction, so as to form elongated longitudinal spaces between adjacent pairs of the elongated lines, respectively. When a worker wants some construction materials to be moved up or down through the parallel line nets, the worker opens (or widens) the elongated spaces in the transverse direction so that the materials can pass therethrough. The term "net" is used herein in a loose sense, not intending to suggest a mesh or criss-cross lattice pattern.

DESCRIPTION OF THE RELEVANT ART

It is well-known in the art that safety is an extremely important consideration at elevated work sites such as construction sites. This is because each year a significant number of construction workers have fallen from elevated positions incurring serious injury or death. Although the danger associated with an elevated work site is well-known, establishment of a safe work environment is difficult for a number of reasons. For example, since gaps are established between scaffolding and a building, workers continue to slip and fall between the scaffold and the building incurring serious injury and death. If the scaffold could be fixed to the building, these gaps would not be established. However, it is actually impossible to attach scaffolding to the outside of building frame because it would not allow fixing the outside walls to the building frame. The provision of inclined concrete surfaces around a building or eaves projecting above window frames also make it difficult to affix scaffolding without creating gaps. This is because assembly of a scaffold vertically above an inclined surface is not an easy task.

To prevent falling accidents at the workplace, what is commonly called a "lifeline" is used. One end of the lifeline is connected to the worker and the other end has a connector which can attach to a position such as the scaffolding or the building. If the lifeline connector is attached to a position such as the scaffold of an elevated site, falls can be prevented even though workers may slip. However, in actual practice, the initial operation of attaching of a parent rope to the building for lifeline connection is difficult, and even when lifelines are available they go sufficiently unused. This is because workers cannot move about freely when lifelines are connected to the scaffold. When a worker's range of movement is limited by a lifeline, efficiency drops markedly.

This results from the requirement to detach the lifeline and re-attach it to another point when the worker moves beyond the range of the lifeline.

To avoid these drawbacks, safety apparatus for construction work which suspend nets to prevent workers from falling between buildings and scaffolds have been developed. For example, Japanese Patent Publication No. 63-65790 issued Dec. 16, 1988, Japanese Non-examined Utility Model Publication No. 59-57656 issued Apr. 14, 1984 and Japanese Non-examined Utility Model Publication No. 4-116544 issued Oct. 19, 1992 disclose safety apparatus for construction work which use nets. As shown in FIG. 1, these disclosures describe use of grid pattern nets 1 having cord material such as rope connected in a grid pattern. Grid pattern nets 1 are fixed to the scaffolding and suspended in a horizontal fashion. For example, when a three story building is constructed, grid pattern nets 1 are suspended in the same planes as the second and third floors and also in the same horizontal plane as the roof restricting any falls to one story or less. A worker slipping and falling off the roof is caught by the grid pattern net 1 in the same plane as the roof, a worker on the third story is caught by the third floor net 1, and a worker on the second floor is caught by the second floor net 1. Further, when grid pattern nets 1 are suspended in floor planes prior to floor construction, falls through the unfinished floors can be prevented.

Consequently, the grid pattern net has the characteristic that work safety can be markedly improved. Irrespective of this, grid pattern nets also go sufficiently unused in practice. This is because grid pattern nets are not only troublesome to suspend, but also drastically reduce the efficiency of construction work operations once they are suspended.

Grid pattern net suspension is troublesome because gaps between buildings and scaffolding at construction sites are not all the same dimensions, and adjustment of the net size to fit the gap size is difficult. Further, another reason grid pattern nets are not convenient to use is their bulkiness when not in use.

Finally, construction work efficiency is drastically reduced because grid pattern net suspension closes off access between floors of a building. This means that construction materials such as boards and window frames cannot be moved efficiently. At construction sites, outside wall building materials and window frames are moved to upper floors through the gap between the building and the scaffold. Large building materials are difficult to move through the inside of the building and they may hit the building during transport, thereby damaging the interior. Consequently, although grid pattern nets have the potential to improve work safety, they are not effectively used in actual practice.

It is not, however, known in the art to provide a safety apparatus using parallel line nets (more accurately parallel line catchers) for elevated work site operations, which ensures worker safety without sacrificing work efficiency. Such an apparatus is important to, for example, catch a falling worker and pass construction material therethrough.

A need was therefore felt to provide a safety apparatus using parallel line catchers for elevated work site operations.

It is another object of the present invention to provide a safety apparatus using parallel line catchers, which attaches to structures easily and conveniently by changing the length of the parallel line catchers to thereby correspond to the width of a structure side walls.

SUMMARY OF THE INVENTION

The aforementioned and other objects of the present invention are accomplished by a safety apparatus for elevated work site operations comprising parallel line nets which are made of elongated lines, and elongated support members for suspending the nets in a horizontal fashion in prescribed locations at an elevated work site. The parallel line nets (more specifically parallel line catchers) are made by a plurality of elongated lines spaced apart from one another at predetermined intervals and connected to elongated support members at both ends. The nets catch falling workers and thereby protect workers from incurring injury due to a fall from an elevated location.

Further, the safety apparatus for elevated work site operations of the present invention is characterized in that the nets for catching workers are parallel line catchers. A parallel line catcher is a plurality of flexible cord members arranged side-by-side at fixed intervals and connected to support members at both ends. The parallel line net prevents injury by safely catching falling workers and, when necessary, the interval between adjacent cord members is widened to thereby provide an opening with an area sufficient to move construction materials through.

Furthermore, the safety apparatus for elevated work site operations of the present invention is characterized in that the support members comprise space adjusting members which support a plurality of lines at predetermined intervals. The lines are connected to each other so that the ends are bound at the outside of the space adjusting members, and the parallel line catchers are attached to a building whereby the bound ends of the lines are connected to the building or scaffoldings directory or via binding cords.

This type of safety apparatus of the present invention suspends the parallel line catchers between the support members, and adjusts the length of the catchers by moving the space adjusting members. According to this structure, the safety apparatus is attached easily to a building or scaffoldings whereby both ends of the parallel lines are bound to one or more bundles at the outside of the support members. Lines bound to one bundle are especially easy to attach to a building or scaffoldings since they do not each need to have their ends attached to the building, individually or separately.

In addition, the safety apparatus for elevated work site operations of the present invention may be characterized in that the space adjusting members are formed by hard rods, and the rods define holes at predetermined intervals so that the individual lines extend through the holes to be held spaced apart from each other at predetermined intervals. The rods have elongated back-up connecting cords inserted through the holes, and the connecting cords serve to prevent the spaces between the lines from widening in case the rods are broken.

The safety apparatus using parallel line catchers for elevated work site operations of the present invention with the configuration described above has the following outstanding characteristics.

(1) Falling accidents are prevented and elevated work site safety is dramatically improved with no reduction in work efficiency. This is because the safety apparatus for elevated work site operations uses parallel line catchers of cord material suspended side-by-side instead of prior art grid pattern nets. Parallel line catchers can catch falling workers and drastically reduce injury and death due to falling. Furthermore, when necessary, cord members suspended side-by-side can be spread apart to allow passage of construction materials through the widened gap. For this reason, even though nets are suspended, building materials can be moved essentially as well as at a site with no net, and there is no loss of efficiency due to net suspension.

(2) The parallel line catchers of the present invention can be suspended in required locations quickly and easily. This is because the safety apparatus for elevated work site operations comprises parallel line catchers of cord material aligned side-by-side. The cord material that makes up a parallel line catcher can be wound, stored, and transported for each, one line at a time. The wound cord material can be moved to the construction site and connected to support members to suspend a net, one line at a time. Prior art safety apparatus for elevated work site operations demand that large grid pattern nets be suspended. Adjustment of the length and width of prior art nets is laborious, stretching a prior art net while holding constant gaps around the perimeter to eliminate all gaps is also laborious, and since prior art nets are bulky they are extremely troublesome to store and transport. Further, prior art nets have the drawback that they are difficult to fold and unfold.

(3) Further, since the safety apparatus uses parallel line catchers, items such as a ladder or a step ladder can be set up to extend through the net. This feature allows one to stand on a ladder or a step ladder above or through the net and move the step ladder, etc. along the parallel line catcher. Accordingly, since the parallel line catcher can also be suspended around the ladder or the step ladder, falls from the ladder are effectively prevented, and since the ladder can be freely moved laterally, work can be performed efficiently.

(4) The safety apparatus using parallel line catchers of the present invention allows for changing of the length of the parallel line catchers according to the size or width of a building, and can be suspended in required locations quickly and easily. This is because the safety apparatus of present invention comprises parallel line catchers which are made of lines, and support members for suspending the catchers in a horizontal fashion, wherein the support members comprise space adjusting members which positions the lines in parallel and the lines are bound at the outside of the space adjusting members. With the safety apparatus of this configuration, it is easy to attach the ends of bound lines to a building or scaffoldings. Therefore this safety apparatus can have the length of the lines between the support members changed, without adjusting the whole length of the lines, by supporting the ends of line from outside of the support members so that the parallel line catchers are maintained horizontal and binding the lines together outside thereof so that the extra length of the lines is adjustable. Consequently, the length of the catchers can be adjusted freely. The safety apparatus for elevated work site operations of the present invention therefore has the advantage that it can be used for differently sized buildings easily and conveniently. In addition, the bound ends of the lines can be very easily connected to a building or scaffoldings because it is not necessary to connect each of the ends separately.

(5) Furthermore, the safety apparatus of the present invention may comprise the space adjusting members formed by hard rods wherein each rod has passing holes formed therethrough at predetermined intervals such that the lines can be and extended therethrough so that the rod can slide along the lines. This type of space adjusting member ensures that the lines will be positioned apart from one another at predetermined intervals. Additionally, it is quite easy to maintain the parallel line catcher horizontal since the space adjusting members are formed by hard rods. The rods of the safety apparatus may also have back-up connecting cords extending therethrough. That type of safety apparatus prevents spaces between the lines from widening even if a rod is broken by the impact of a worker falling into the parallel line catcher.

These and other features of the invention will be understood upon reading of the following description along with the drawings.

DESCRIPTION OF THE PREFERRED EMBODIMENTS

Embodiments of the present invention are explained with reference to the drawings in the following. However, the following embodiments are for the purpose of presenting concrete examples of the technology of the safety apparatus for elevated work site operations of the present invention, and the present invention is in no way restricted to the following embodiments.

Figure 1:
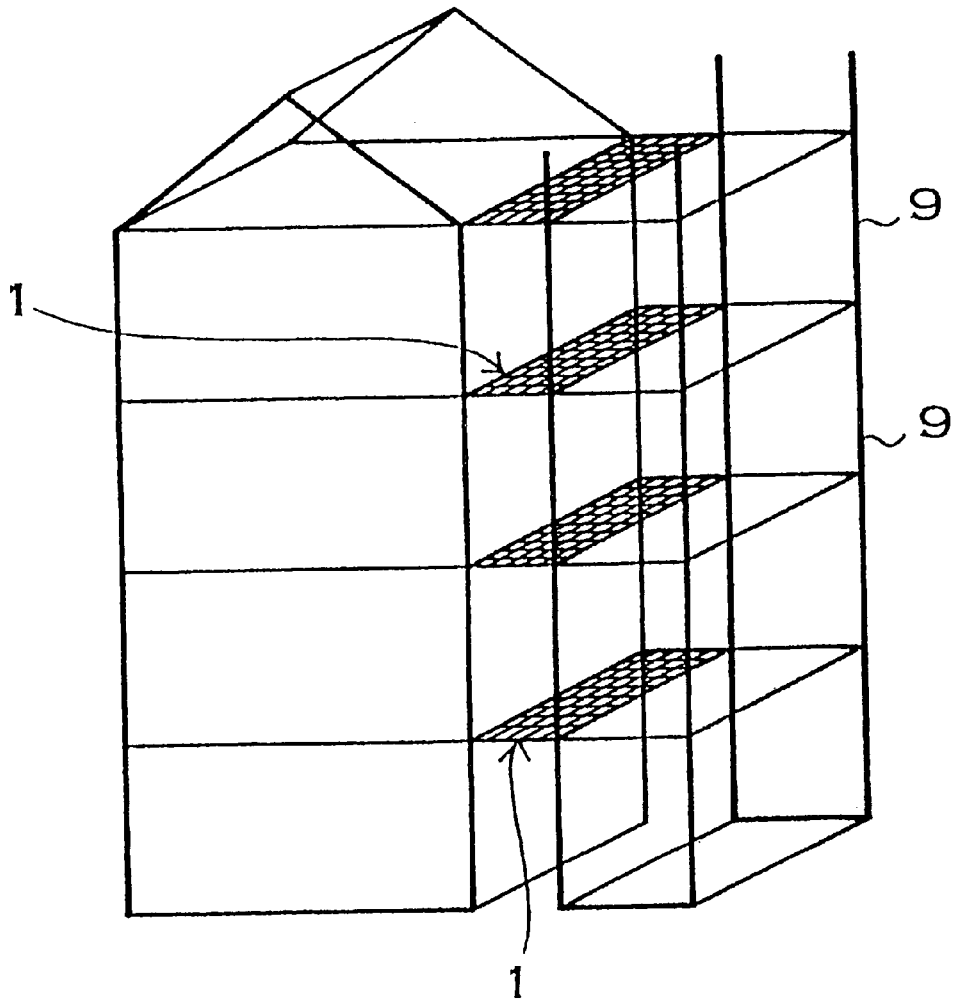
FIG. 1 (PRIOR ART)
FIG. 1 is a perspective view showing use of a prior art construction work safety apparatus net.
Figure 2:
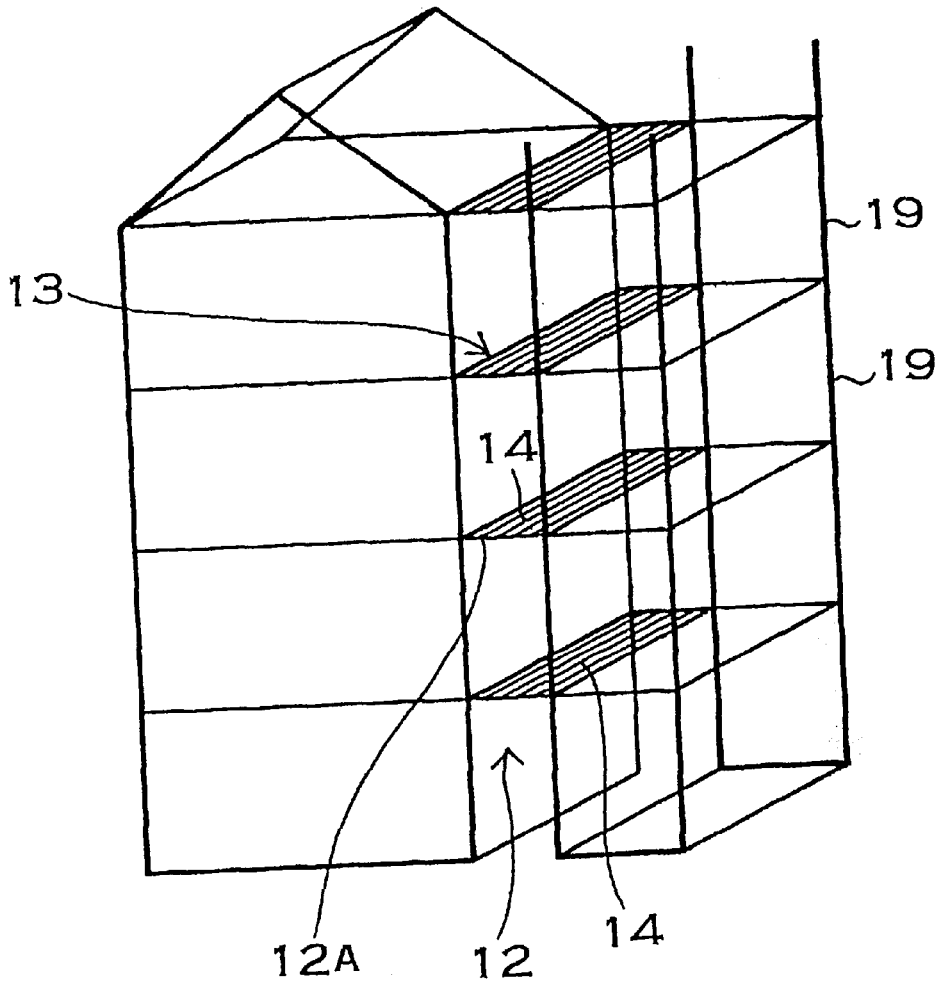
FIG. 2 is a perspective view showing use of an embodiment of the safety apparatus for elevated work site operations of the present invention.

Turning to FIG. 2, the safety apparatus for elevated work site operations, such as for the construction site shown, is provided with parallel line nets 13 made of line material and supports 12 for suspending the parallel line nets 13 in a horizontal fashion at prescribed locations on a building. The supports 12 are also the scaffolding assembled next to the building. The supports 12, which are the scaffolding, are fixed vertically, for example, at a distance of 20 to 100 cm from the building. Prior art scaffolding can be used for the supports 12. However, in the safety apparatus for elevated work site operations of the present invention, the supports are not restricted to scaffolding. Special purpose materials may also be used as supports in place of scaffolding.

Figure 3:
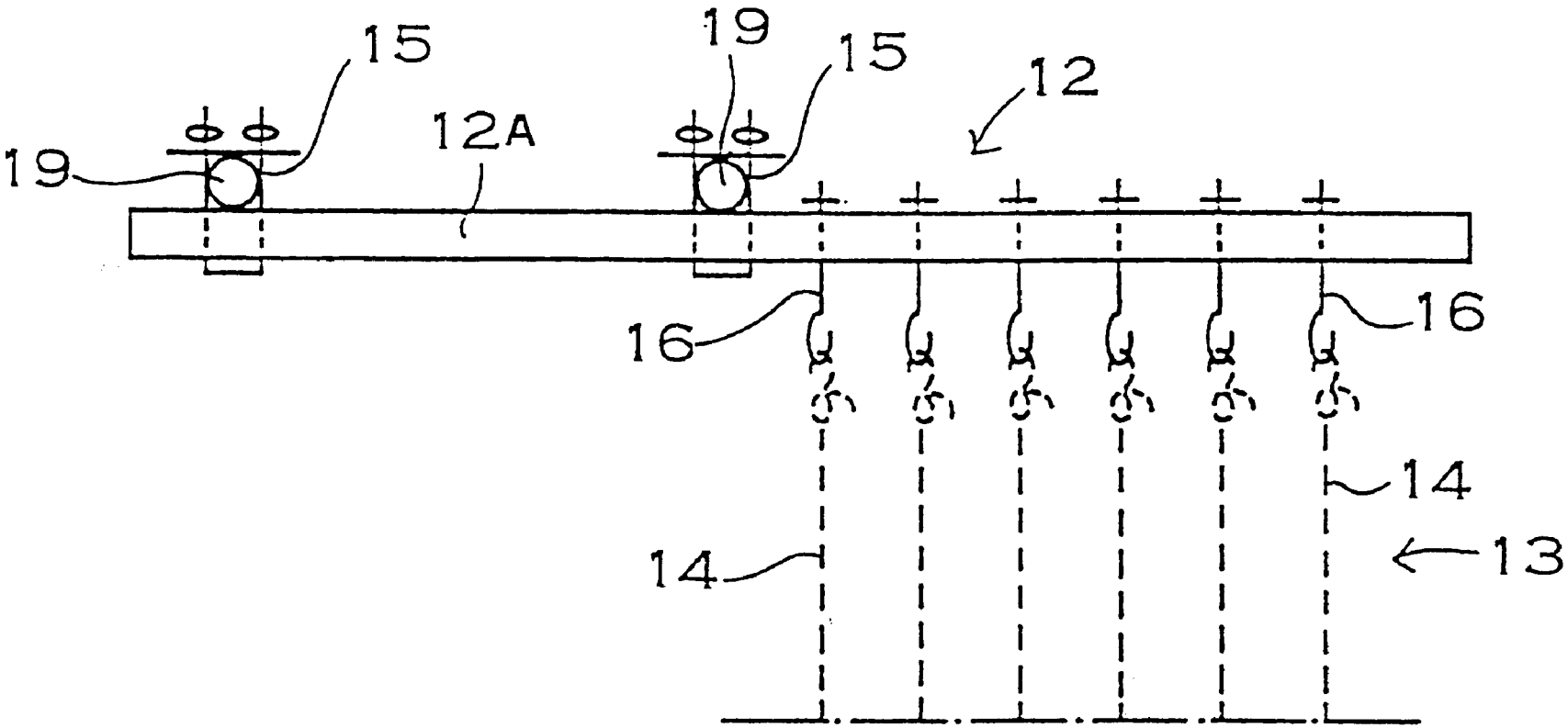
FIG. 3 is a plan view showing cord members of a parallel line net connected to a horizontal rod.

Horizontal rods 12A are fixed to the supports 12 of FIG. 2 for connecting parallel line nets 13 in the gaps between the scaffold and the building. As shown in FIG. 3, a horizontal rod 12A is fixed in a horizontal fashion to vertical columns 19 of the scaffold via connecting hardware 15. The attachment position of horizontal rods 12A on the supports 12 can be adjusted to determine the horizontal position of the parallel line nets 13.

Figure 4:
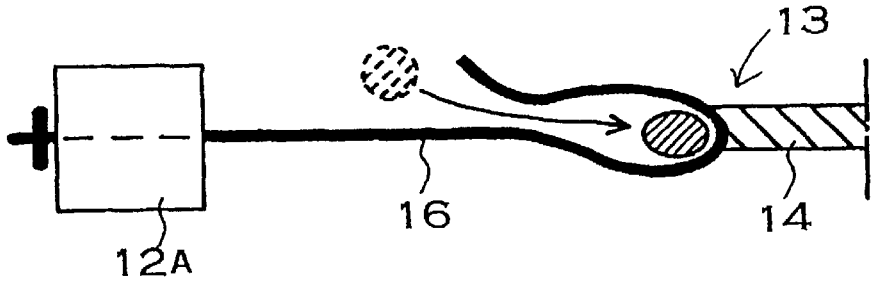
FIG. 4 is a side view showing a section of a cord member of a parallel line net connected to a horizontal rod.

As shown in FIG. 3, the horizontal rods 12A have connecting hooks 16 fixed at regular intervals for simple connection of cord members 14. As shown in the cross section view of FIG. 4, the front end of a connecting hook 16 is curved in a U-shape, and the back end passes through the horizontal rod 12A and is fixed by a retainer to prevent its disconnection. The front end hook part of the connecting hook 16 has a hook opening which is smaller than the outside diameter of the cord member 14 to prevent disconnection of attached cord member 14.

Figure 5:
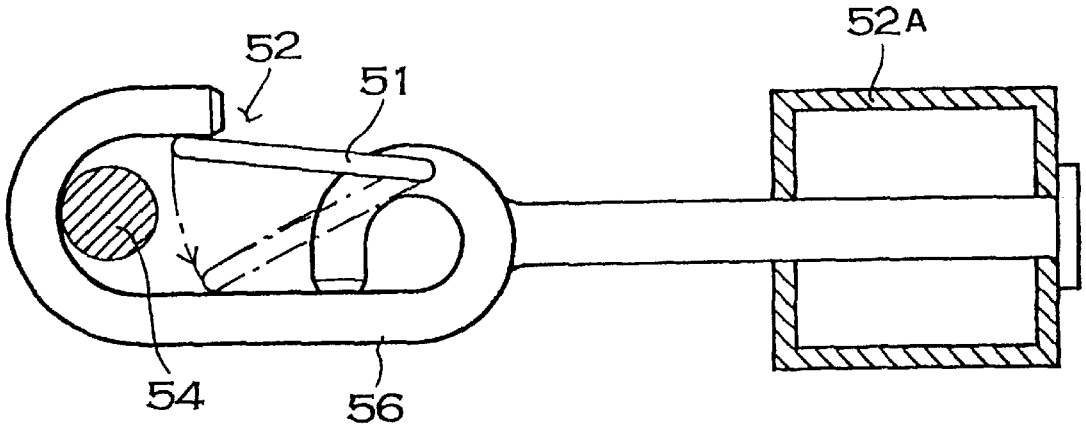
FIG. 5 is a side view in partial cross section showing a cord member connected to a horizontal rod via a connecting hook.

The hook shown in FIG. 5 can be used as a connecting hook. The connecting hook 56 shown in FIG. 5 is provided with an opening section 52 which can be opened to insert a cord member line 54. A lever 51 which can be opened and closed is provided at the opening section 52. The lever 51 is spring loaded to close the opening section 52 and is capable of moving to the broken line position for access to the cord member line 54.

The interval between connecting hooks 16 on a horizontal rod 12A is specified to be the same as the interval between cord material 14 of the net. The interval between connecting hooks 16 is preferably adjusted to be approximately 10 cm. This is because cord members 14 at a 10 cm interval can safely catch and stop the fall of a worker. However, the safety apparatus for elevated work site operations of the present invention does not restrict the size of the cord member 14 interval. The cord member 14 interval is determined to prevent a worker from falling out of the net and is set, for example, in the range from 3 to 30 cm, or more desirably in the range from 5 to 20 cm, or most desirably in the range from 5 to 15 cm. Further, the intervals between cord member lines may be random rather than fixed.

Figure 6:
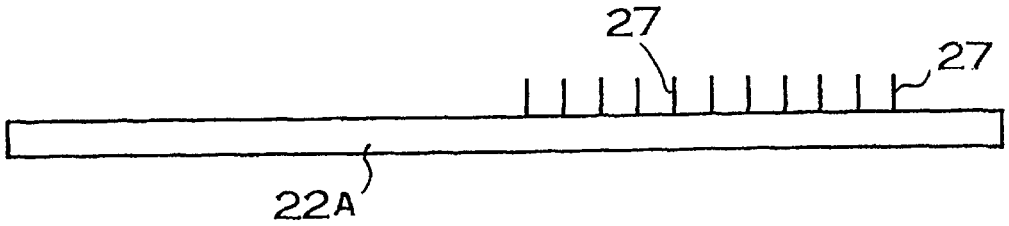
FIG. 6 is a plan view of a horizontal rod of another embodiment of the present invention.

Turning to FIG. 6, a horizontal rod 22A is shown which has projections 27 fixed at regular intervals to prevent attached cord material 24 from sliding laterally. This type of horizontal rod 22A is provided with many projections 27 and is used by attaching cord member lines al 14 between the projections 27.

The parallel line nets 13 connected to supports 12 as shown in FIG. 2 comprise a plurality of flexible cords 14 suspended in a horizontal fashion. The line of the cord members 14 that make up the parallel line nets 13 is rope with sufficient strength to catch a falling worker without breaking or rope connected with elastic rubber material of sufficient strength (not illustrated). Rope with elastic rubber material connected has the property that it will stretch when a worker falls on the net and reduce the shock of impact. This type of net has the characteristic that falling workers are more safely protected. The parallel line nets 13 have cord members 14 suspended at intervals that prevent the worker from falling through the net.

Figure 7:
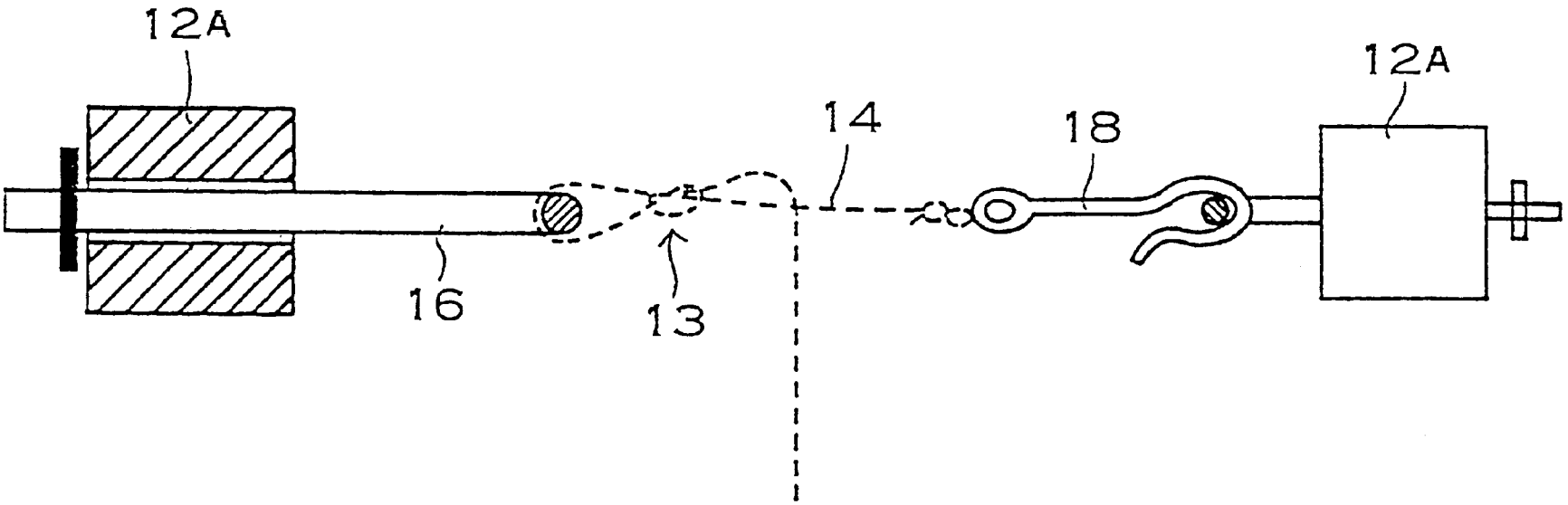
FIG. 7 is a side view in partial cross-section showing a cord member of a parallel line net connected to horizontal rods.

Turning to FIG. 7, a hook 18 is shown connected to one end of the cord member 14 to simplify connection to the horizontal rods 12A. Only one end of each cord member 14 has a hook 18 connected thereto. As shown in FIG. 7, the other end of the cord member 14 with no hook 18 is tied to a connecting hook 16 on a horizontal rod 12A. This type of cord member 14 with a hook 18 at one end and no hook 18 at the other end has the characteristic that its length can be easily adjusted to fit between horizontal rods 12A with different spacing dimensions.

Since the length of the required parallel line net 13 depends on the construction site operation being performed, cord members 14 which can easily be adjusted in length are convenient to use. The length of one line of cord member 14 is designed to be, for example, from 2 to 10 m, and preferably from 3 to 10 m. Cord members 14 that are shorter than the space between horizontal rods 12A can be lengthened by connecting a plurality of cord members 14 together. Cord members 14 can be connected together by hooking the two hook 18 ends together or by tying a rope end to a hook 18 end.

Figure 8:
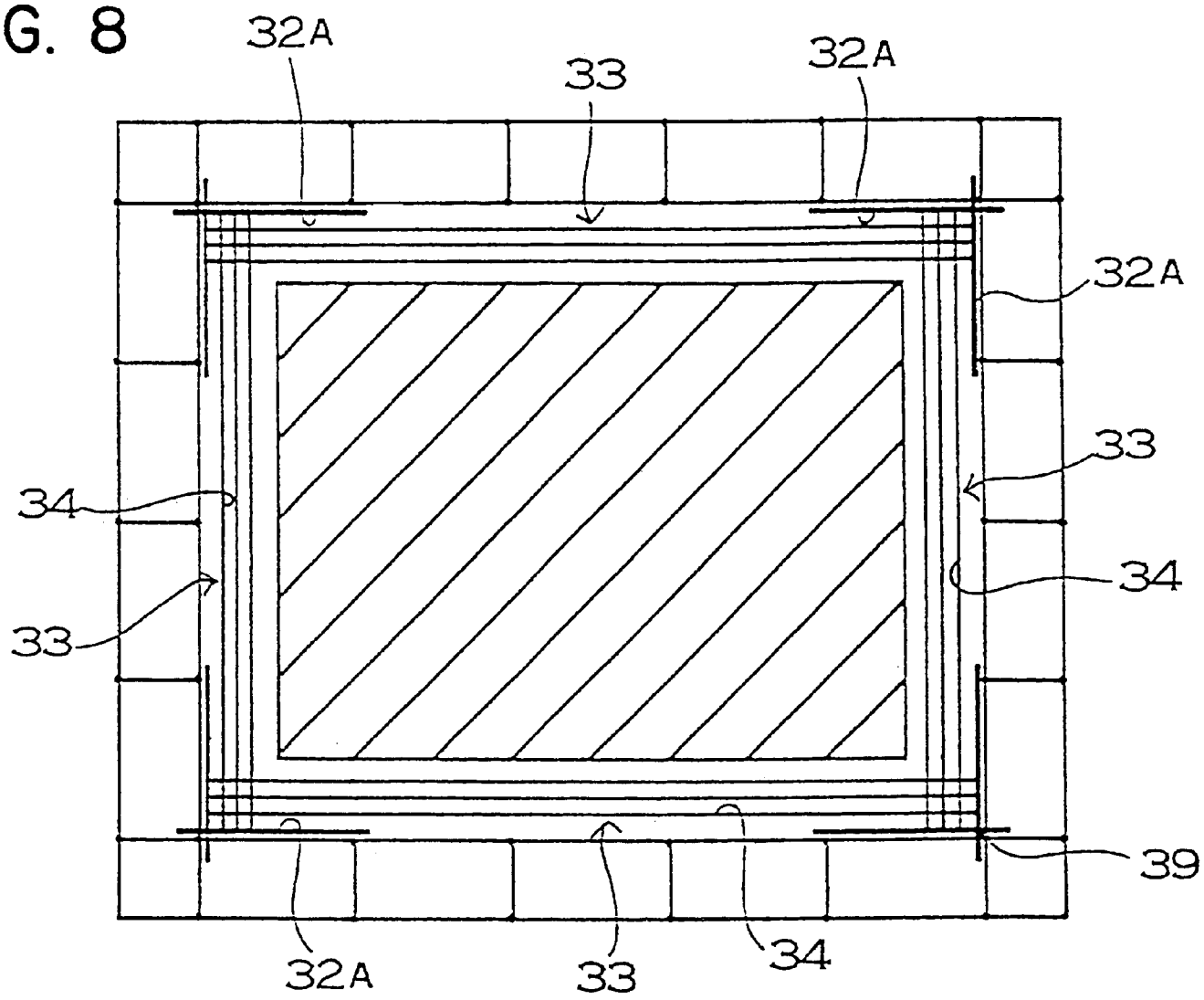
FIG. 8 is a plan view showing another embodiment of the safety apparatus for elevated work site operations of the present invention.

FIG. 2 shows a safety apparatus for elevated work site operations attached to one side of a building. Ideally the safety apparatus for elevated work site operations of the present invention is set up around the entire perimeter of a building as shown in FIG. 8. In the safety apparatus for elevated work site operations shown in FIG. 8, the horizontal rods 32A are fixed to vertical columns 39, and the cord members 34 of the parallel line nets 33 are connected to these horizontal rods 32A. Connection of the cord members 34 can be in the same configurations as shown in FIGS. 3 through 7.

Figure 9:
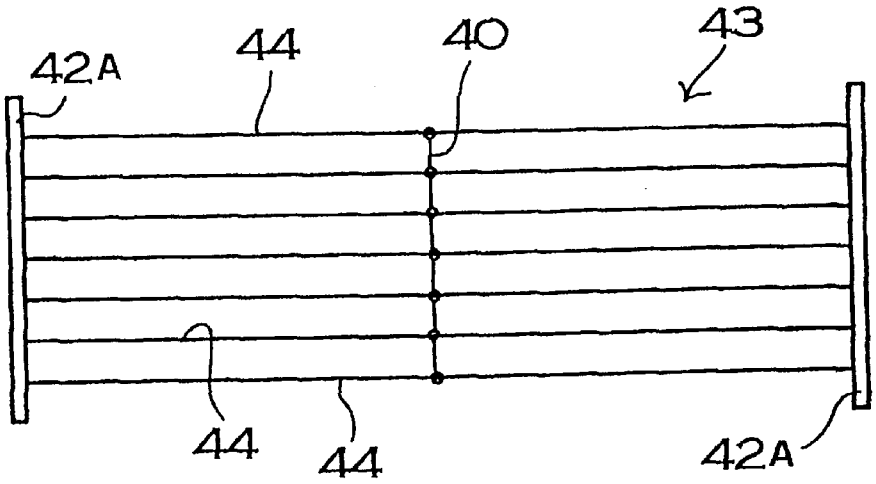
FIG. 9 is a plan view of an embodiment of a parallel line net.
Figure 10:
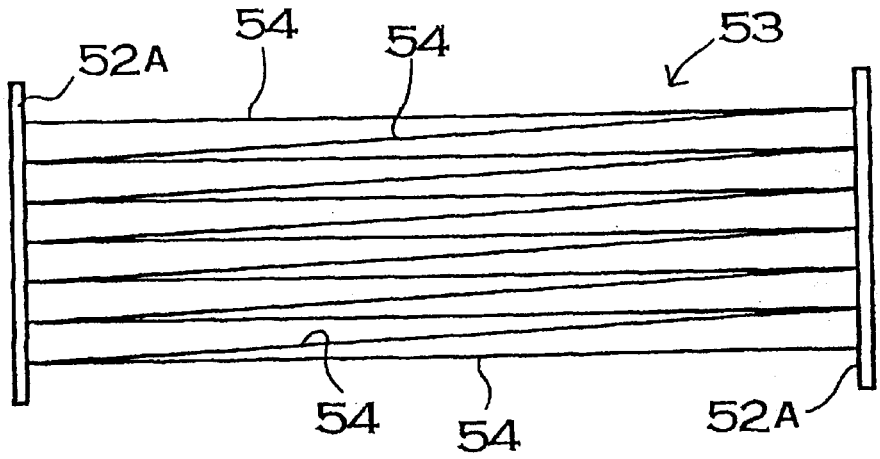
FIG. 10 is a plan view of another embodiment of a parallel line net.

In the safety apparatus for elevated work site operations of the present invention, a plurality of cords members 44 are preferably suspended in parallel to establish a parallel line net 43 as shown in FIG. 9. However, as shown in FIG. 10, a single line of cord material 54 may also be strung through the horizontal rods 52A in a zigzag pattern to establish the parallel line net 53. The parallel line net 53 shown in FIG. 10 can be made from a single long line of cord material 54 or a plurality of cord members 54 connected to make a single long line. There is no need to adjust the individual lengths of multiple cord members 54 connected to horizontal rods 52A in the parallel line net 53 of FIG. 10. It is only necessary to adjust and connect the very end of the entire line of cord material 54 to the horizontal rod 52A.

As shown in FIG. 9, a parallel line net 43 in which the ends of the cord member 44 connect to widely separated horizontal rods 42A has an intermediate connecting member 40 at the midpoint of the cord member 44 lines. One or a plurality of intermediate connecting members 40 are provided at intermediate points along the cord members 44. However, the safety apparatus for elevated work site operations of the present invention has the unique structure which allows construction materials to pass through a widened interval between cord members 44 of the parallel line net 43. Therefore, the distance between intermediate connecting members 40 or between an intermediate connecting member 40 and a horizontal rod 42A of a parallel line net 43 must be long enough to allow adjacent cord members 44 to be spread apart and construction materials to be passed through. For example, this distance should be at least 1 m or more, preferably 2 m or more, and most desirably 3 m or more. The intermediate connecting material may also be capable of moving freely along the cord members. This type of intermediate connecting member has rings, for the cord members to pass through, connected at intervals equal to the intervals between cord members.

The above embodiments describe suspension of the safety apparatus of the present invention around buildings. However, the safety apparatus for elevated work site operations of the present invention is not restricted to construction work applications. For example, although not illustrated, parallel line nets can be suspended around utility poles to improve utility pole work safety, parallel line nets can be suspended adjacent to bridges to improve bridge construction safety, and parallel line nets can be suspended at civil engineering elevated construction sites to improve safety. Further, parallel line nets can be suspended below unfinished floors before finishing floors, beams and floor joists inside of the construction to improve construction work safety.

Figure 11:
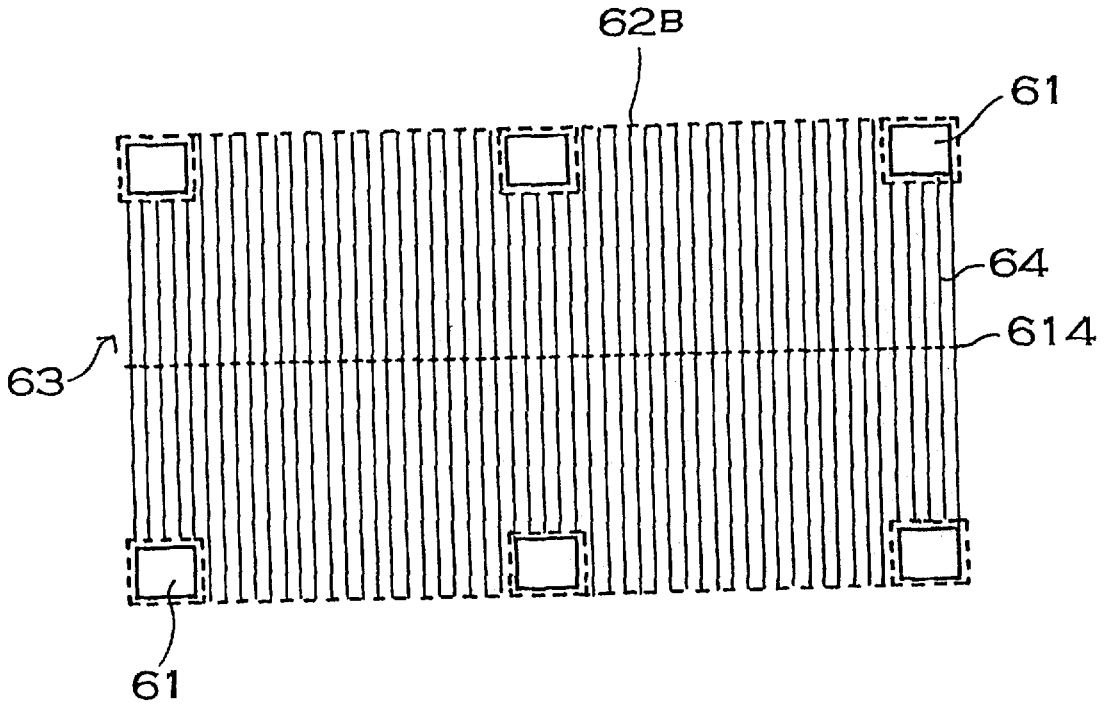
FIG. 11 is a plan view showing a suspended parallel line net which extends under an entirety of each floor of a structure.
Figure 12:
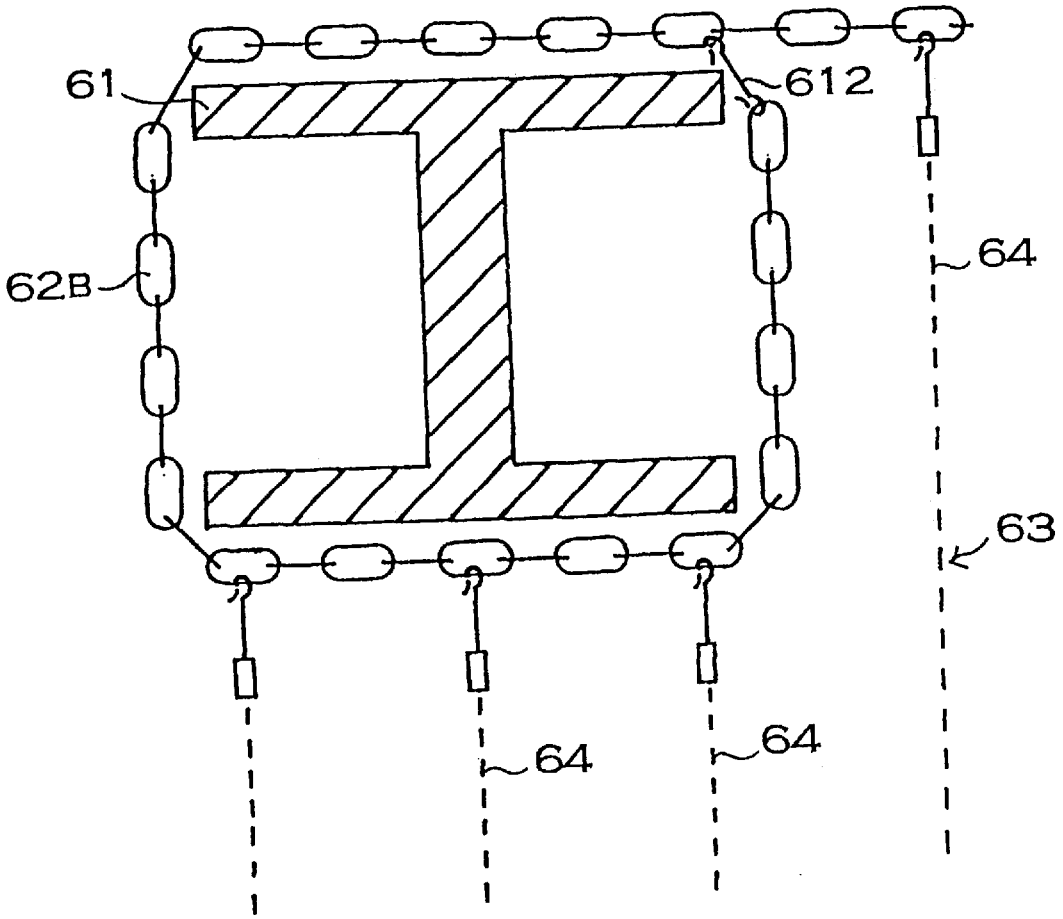
FIG. 12 is a plan view showing the connection of cord material and a chain used as a support to a vertical column of a building.
Figure 13:
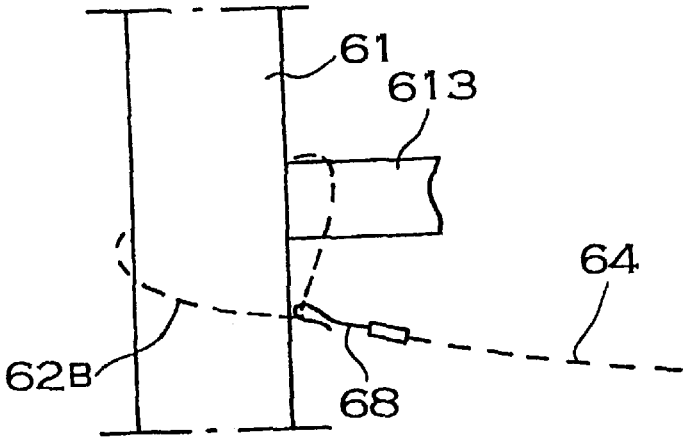
FIG. 13 is a side view showing the connection of a chain used as a support to a vertical column and a cross beam of a building.

Chains may also be used as supports for connecting parallel line nets. The cord members of a parallel line net can be connected to chains without using connecting hooks. Cord members can be connected to the links of a chain to avoid any lateral sliding of the cord members. For this reason, when chains are used as supports, there is no need for connecting hooks. Cord members can be connected to chains at fixed intervals. As shown in FIG. 11 and 12, chains 62B used as supports 62 are connected to building columns 61. The chains 62B are wrapped around the columns 61 and held in place by locking hooks 612. Further, as shown in FIG. 13, the chains 62B are connected to cross beams 613 to prevent the chains 62B from sliding downwards. The cord material 64 lines are connected to links of the chains 62B. The hook 68 end of the cord member 64 can be hooked into a link of a chain 62B for connection. The cord member 64 end with no hook can be passed through a link of a chain 62B and tied for connection.

Figure 14:
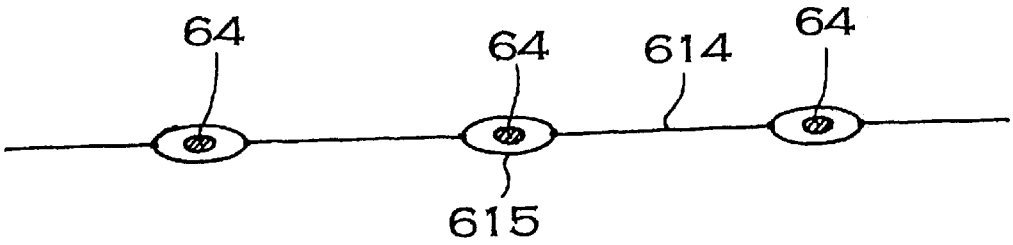
FIG. 14 is a side view in partial cross section showing cord material lines passing through rings of intermediate connecting material.

FIG. 11 shows a parallel line net that is suspended over the entire area under each floor of a construction site. The safety apparatus of this figure will safely catch workers who fall in the interior of the building. The parallel line net of the safety apparatus of FIG. 11 is also connected at its median by an intermediate connecting member 614. As shown in FIG. 14, the intermediate connecting member 614 has rings 615, which the cord members 64 can pass through, spaced at intervals equal to the intervals between cord members 64. In this configuration, the intermediate connecting member 614 can be moved by sliding the rings 615 along the cord members 64. It therefore has the feature that when the intermediate connecting member 614 gets in the way, it can be moved out of the way along the cord members 64.

Figure 15:
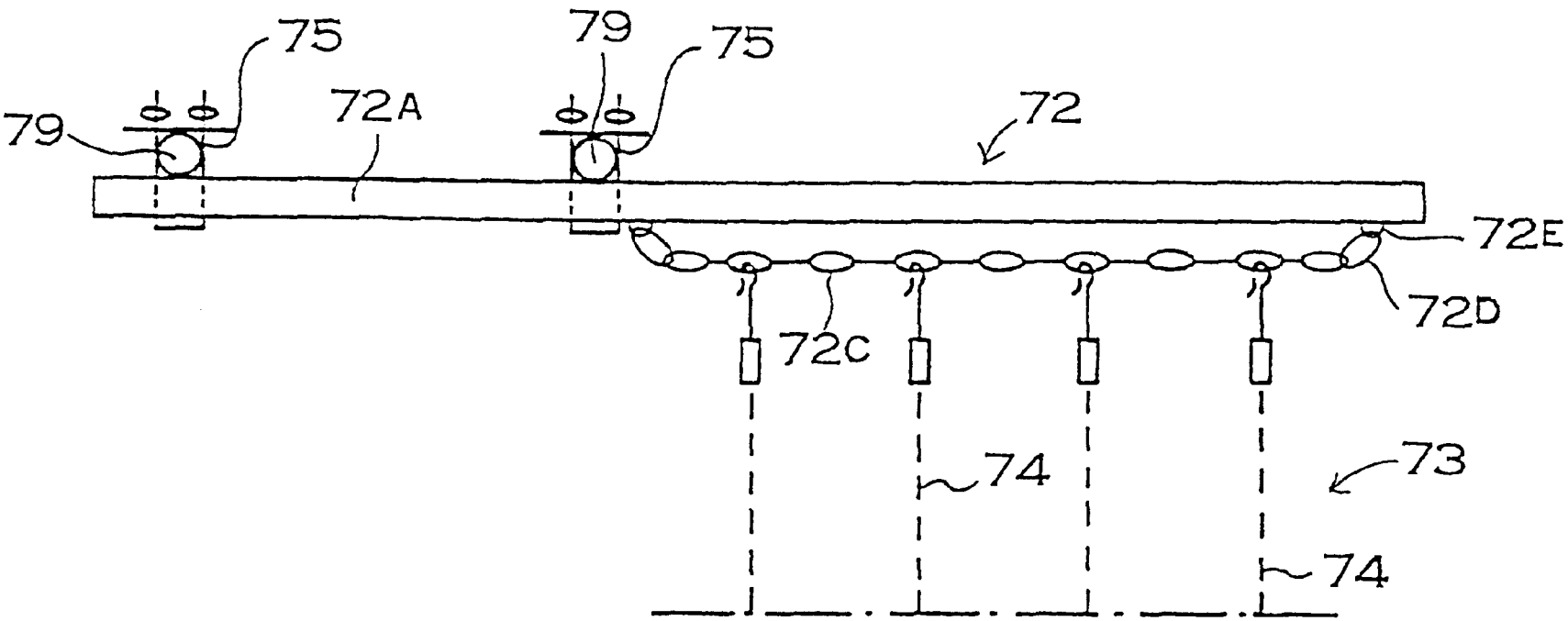
FIG. 15 is a plan view showing connection of cord members to supports.
Figure 16:
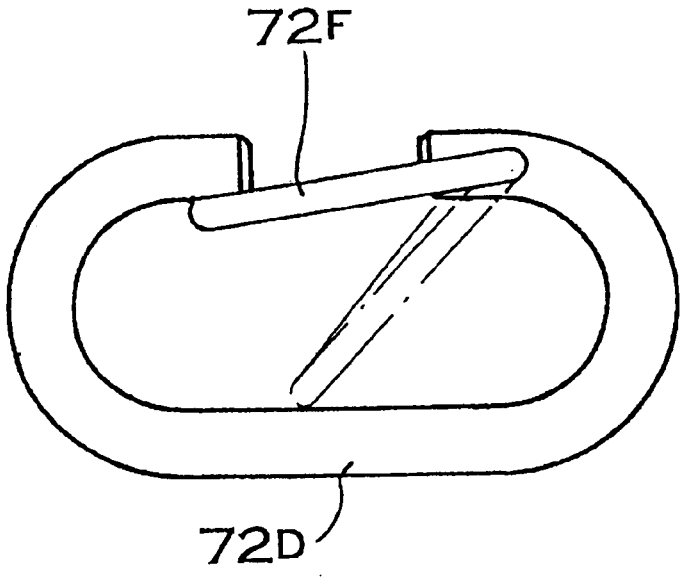
FIG. 16 is a plan view showing a link used in the supports shown in FIG. 15.

A support 72 of FIG. 15 has a short chain 72C connected to a horizontal rod 72A and cord members 74 connected to the short chain 72C. The short chain 72C connects to hooks 72E on the horizontal rod 72A via links 72D which have a lever 72F which can open and close a section of the link 72D as shown in FIG. 16. The short chain 72C has four cord members 74 connected. A plurality of cord members can be easily connected in this configuration.

Figure 17:
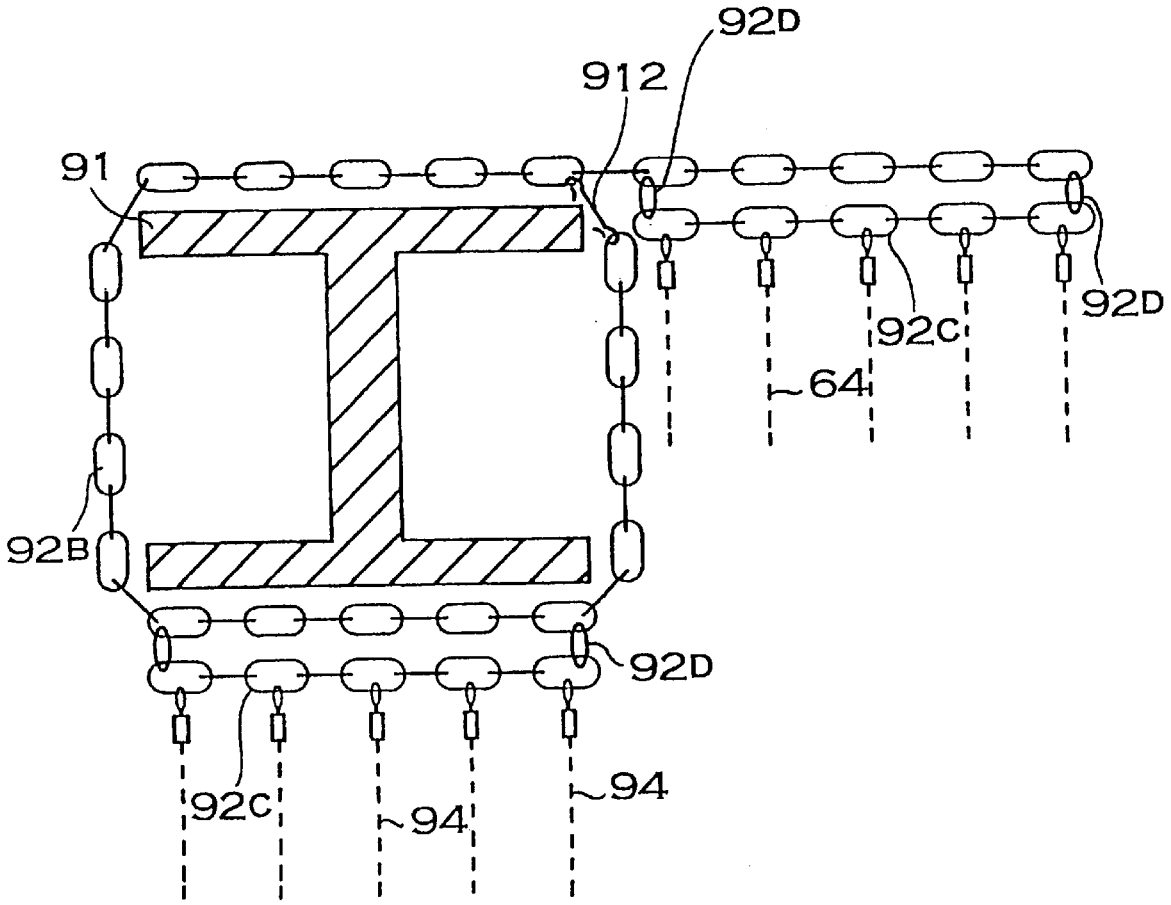
FIG. 17 is a plan view showing the connection of cord members to supports connected to a vertical column.
Figure 18:
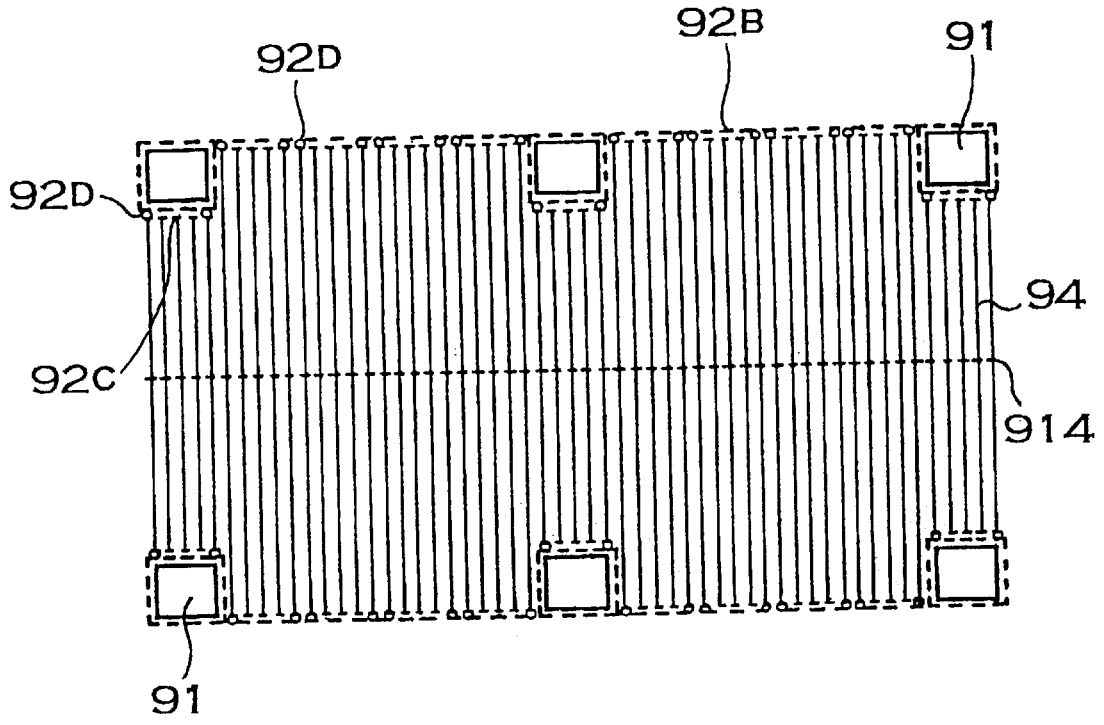
FIG. 18 is a plan view showing the connection of cord members to supports connected to vertical columns.

Further, the safety apparatus shown in FIGS. 17 and 18 has a plurality of cord members 94 connected to short chains 92C which in turn are connected via links 92D, of the type shown in FIG. 16 to chains 92B which are the supports. The chains 92B are wrapped around columns 91 for connection to the building.

Another embodiment of the safety apparatus of the present invention is shown in FIG. 19. As shown in FIG. 19, the safety apparatus for elevated work site operations has parallel line catchers 1903 made of a plurality of elongated lines (or cord members) 1904, and spaced apart support members 1902 for suspending the parallel line catchers 1903 in a horizontal fashion at prescribed locations on a building.

The support members 1902 support the elongated lines 1904, and lines 1904 are extended between support members 1902 in a substantially longitudinal direction. The elongated lines 1904 are disposed parallel to one another and are spaced apart from one another in a transverse direction, so as to form elongated longitudinal spaces between adjacent pairs of said elongated lines 1904, respectively. Each of said elongated spaces is free of any transversely extending obstruction over a longitudinal distance substantially greater than a transverse distance between each adjacent pair of said elongated lines 1904.

The elongated lines 1904 are formed by a plurality of flexible cord members suspended in a horizontal fashion and supported by support members 1902 spaced apart from each other at predetermined intervals. The cord members that makes up the parallel line catchers 1903 are such as rope, elastic rubber material, or rope respectively connected at an intermediate position to elastic rubber material which is of sufficient strength to catch a falling worker without breaking. The elastic rubber material has the property that it will stretch elastically when a worker falls on the net and reduces the shock of impact. This type of net has the characteristic that falling workers are more safely protected.

Figure 20:
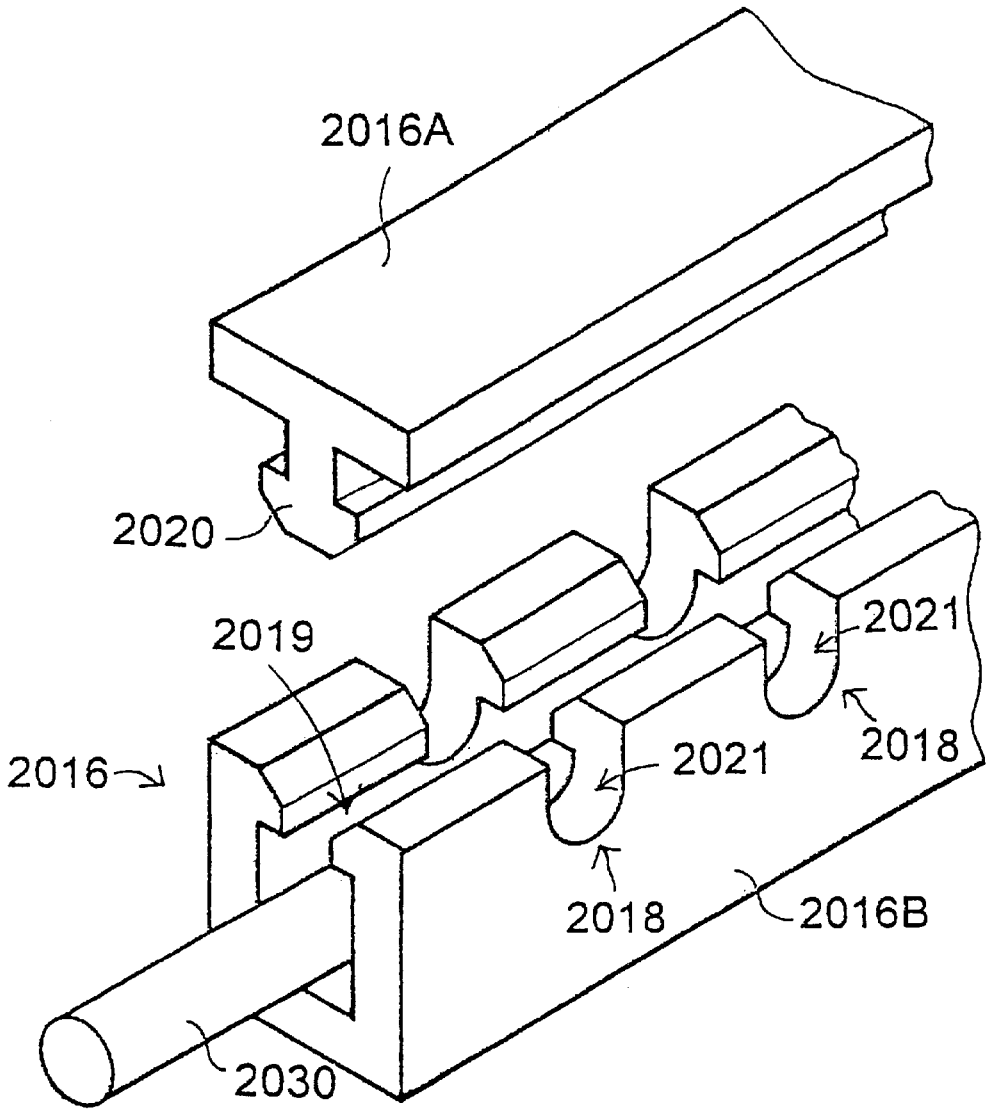
FIG. 20 is an exploded perspective view of an embodiment of a space adjusting member of a safety apparatus.
Figure 21:
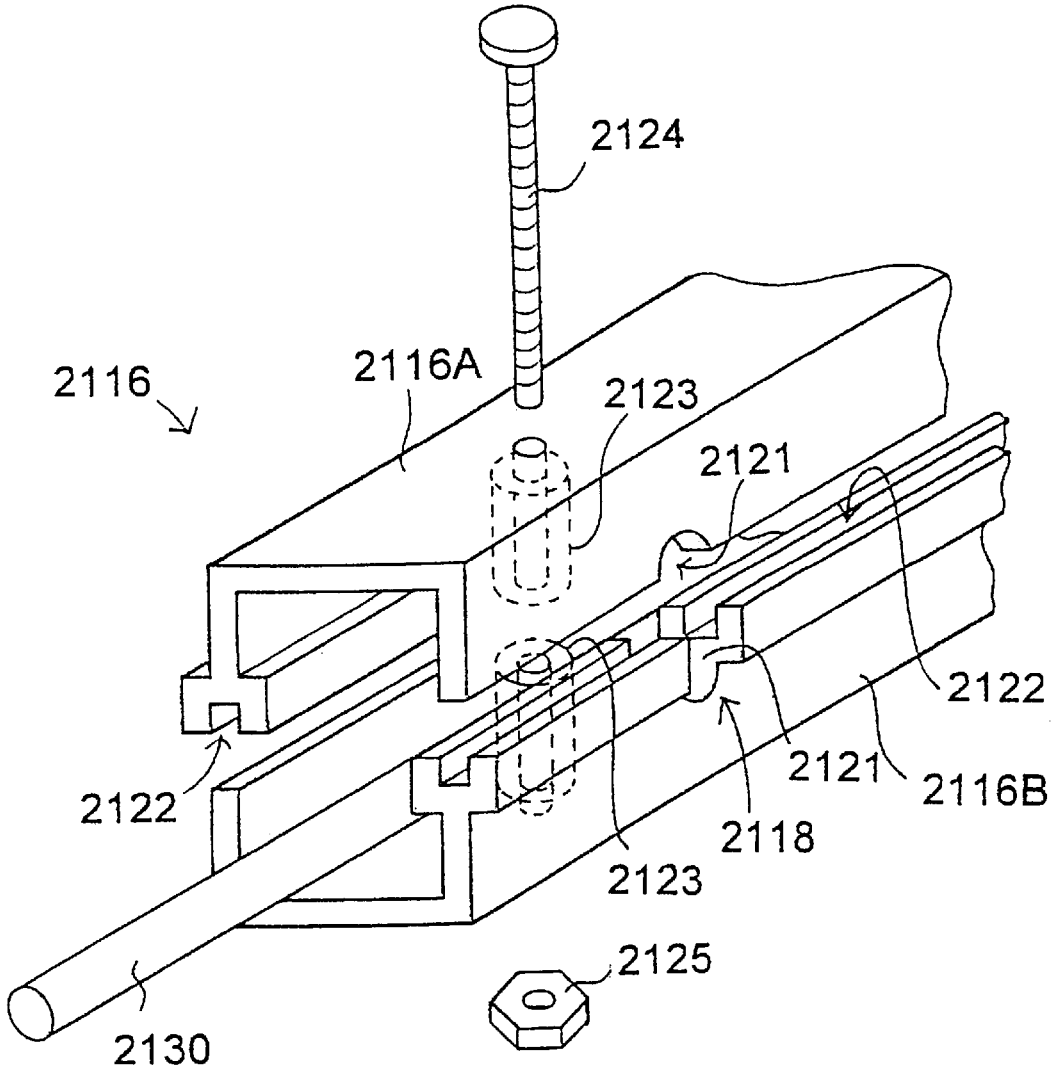
FIG. 21 is an exploded perspective view of another embodiment of a space adjusting member.

The spaced apart support members 1902 comprise a plurality of elongated space adjusting members 1916 which support a plurality of lines 1904 in parallel and spaced apart at predetermined intervals, and a plurality of connecting binders 1917, each of which binds a plurality of elongated lines 1904 into a bundle. The space adjusting members shown in exploded perspective view in FIGS. 20 and 21 are made by hard rods formed of plastic. These space adjusting members have a plurality of openings 2018 through which the lines 1904 are extended so as to be spaced part at predetermined intervals. The space adjusting member 2016 shown in FIG. 20 comprises an upper side rod 2016A and a lower side rod 2016B so as to divide into two parts. The upper side rod 2016A and lower side rod 2016B are formed to connect easily.

The lower side rod 2016B of the space adjusting member 2016 shown in FIG. 20 is formed with a groove 2019 which is narrower at an upper portion than at a lower portion. The upper side rod 2016A is formed with a T-shape in cross-section so that a projection 2020 projects downwardly at a lower portion thereof. The T-shaped upper side rod 2016A is connected to the lower side rod 2016B by inserting the projection 2020 of the upper side rod 2016A into the groove 2019 of the lower side rod 2016B. The projection 2020 of the upper side rod 2016A forms a retainer as shown in FIG. 20 to prevent disconnection of the upper and lower side rods 2016A and 2016B. The lower side rod 2016B forms slots 2021 at both sides to introduce lines 1904 thereinto in longitudinal direction (not illustrated). In the illustrated arrangement, the projection 2020 serves to lock the space adjusting member 2016 against movement along the lines 1904 when the upper side rod 2016A is secured to the lower side rod 2016B, due to the projection 2020 pressing against the lines 1904. However, the projection can alternately be configured with slots similar to the slots 2021 but inverted relative thereto, or can be shortened so as to not press against the lines 1904, if it is desired to not lock the spaced adjusting member 2016 against movement along the lines 1904.

Another space adjusting member 2116 shown in FIG. 21 is formed in a rectangular shape with one open side in cross-section for inserting a back-up connecting cord 2130. The space adjusting member 2116 as shown in FIG. 21 comprises upper and lower side rods 2116A, 2116B formed with the same shape. This type of space adjusting member is more convenient and efficient for mass production. Each of the upper and lower rods 2116A, 2116B has two sides. An integrally formed elongated ditch 2122 is formed at one side of each of the upper and lower rods, and an elongated edge is integrally formed at the other side of each of the upper and lower rods. The edge of one of the rods engages in the ditch of the other rod, and the edge of the other rod engages in the ditch of the one rod. The space adjusting member with this configuration has an advantage in that it is possible to connect the upper and lower side rods together in place by engaging the edge side of one rod to the ditch of the other rod. Each of the upper and lower side rods has formed integrally therewith a plurality of connecting pipes 2123 inside of the opening of the rod at predetermined intervals (shown by broken lines). The upper and lower side rods are connected together in precise position by inserting a screw 2124 through corresponding connecting pipes 2123 and screwing the screw 2124 into a nut 2125. In addition, each of upper and lower side rods also forms a plurality of slots 2121 at both sides to form passing holes 2118 to allow lines to be inserted thereinto in the longitudinal direction (not illustrated).

By using this type of spaced adjusting member, the lines can pass though passing holes at first by putting the lines into the slots 2121 of the lower side rod, respectively, then fitting the upper side rod and the lower side rod together. Therefore, instead of inserting many lines into passing holes directly, the lines can penetrate the passing holes of the space adjusting member easily by simply putting the lines into the slots of one side rod.

Moreover, the space adjusting members shown in FIGS. 20 and 21 have inserted thereinto elongated back-up connecting cords, respectively. The elongated back-up connecting cords prevent the elongated spaces between the lines from widening the transverse distance of the elongated spaces in case the space adjusting member is broken by the impact of a worker falling into parallel line catcher. Therefore, as shown in FIG. 20 the support members with space adjusting members 2026 having back-up connecting cords 2030 inserted therein are extremely safe. In addition, this type of the support members with space adjusting members 2016 having the back-up connecting cords 2030 extending therethrough can be usable safely without requiring so strong of hardness of the rods for the space adjusting members 2016. In order to prevent the back-up connecting cord 1930 from slipping out of the groove of the space adjusting member 1916, the back-up connecting cord 1930 may be tied to make knots (also referred to as nodes) 1931 near ends of the space adjusting member 1916, as shown in FIG. 19. However, the safety apparatus of the present invention is not restricted to using this type of knots as stoppers to prevent the movement of the back-up connecting cord relative to the space adjusting member in the transverse direction. Other type of stoppers which can prevent the movement of the back-up connecting cord may also be applicable to the present invention.

Figure 22:
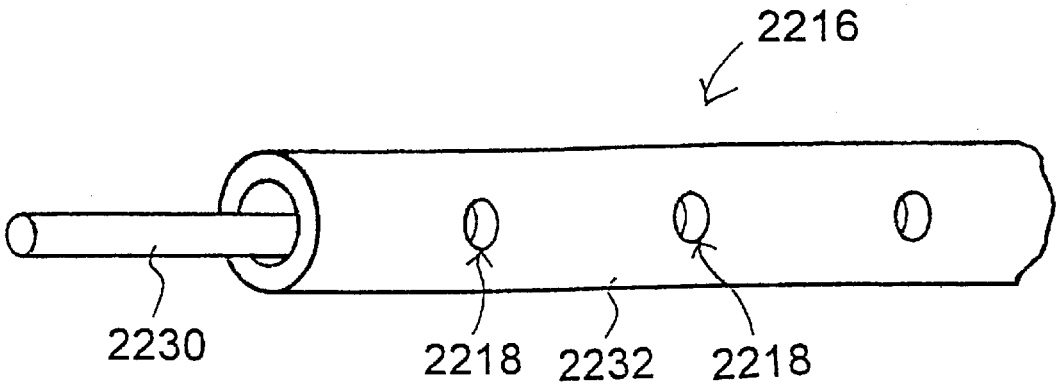
FIG. 22 is a perspective view of another embodiment of a space adjusting member.

FIG. 22 shows a space adjusting member 2216 which is a hollow pipe 2232 has a back-up connecting cord 2230 inserted therethrough. Non-hollow rods with spaced apart passing holes opening at predetermined intervals (not illustrated) may also be usable. The space adjusting member 2216 shown in FIG. 22 is made by cutting a plastic pipe at a predetermined width and forming passing holes 2218 at predetermined intervals. This type of the space adjusting member is easy to manufacture, and has a reduced production cost. Moreover, a wooden rod having passing holes formed at predetermined intervals may also be usable as the space adjusting member (not illustrated). This wooden type structure can be mass produced at low cost.

Figure 23:
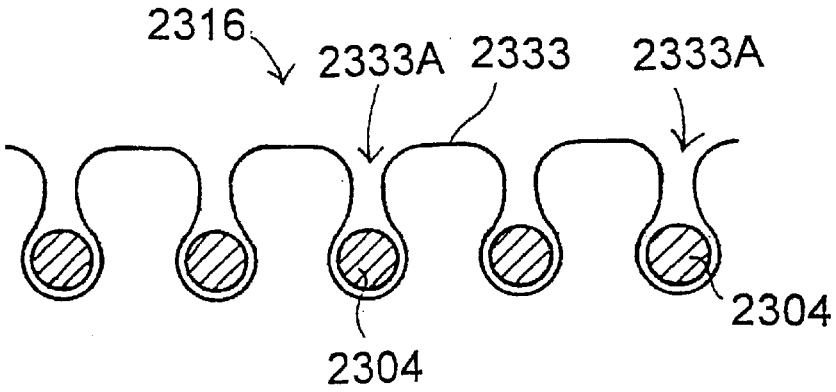
FIG. 23 is a cross-sectional view of another embodiment of a space adjusting member.

Furthermore, as shown in FIG. 23, a space adjusting member 2316 may comprise material 2333 made by metal or plastic wire or sheet in a curved shape. The space adjusting member 2316 as shown in FIG. 23 comprises a plurality of U-shaped portions 2333A coupled to each other in line, and the lines 2304 are inserted into the U-shaped portions 2333A, respectively. Each of the reverse-U-shaped portions 2333A forms an opening which has a narrower width than the outside diameter of the lines 2304 as shown in FIG. 23. This type of the space adjusting member 2316 holds the lines 2304 in the reverse-U-shaped portions 2333A at the predetermined intervals by inserting the lines 2304 into the openings of the reverse-U-shaped portions 2333A, respectively. The lines 2304 are inserted into the openings of the reverse-U-shaped portion 2333A by widening the openings thereof flexibly or by inserting the lines 2304 directly without widening the openings.

Preferably, the intervals between the adjacent lines supported by support members disposing the lines apart at the predetermined intervals in parallel fashion are set at approximately 3 cm. This is because the lines disposed at 3 cm intervals are able to catch a falling worker safely. However, in the safety apparatus using parallel line catchers for elevated work site operations of the present invention, the intervals between the adjacent lines are not restricted to 3 cm. The intervals of the lines may also be determined so that the parallel line catcher is able to catch a falling worker. For example, the interval is variable within the range of 2–20 cm, preferably 2–10 cm, or more preferably, 2–5 cm.

Figures 19A, 19B:
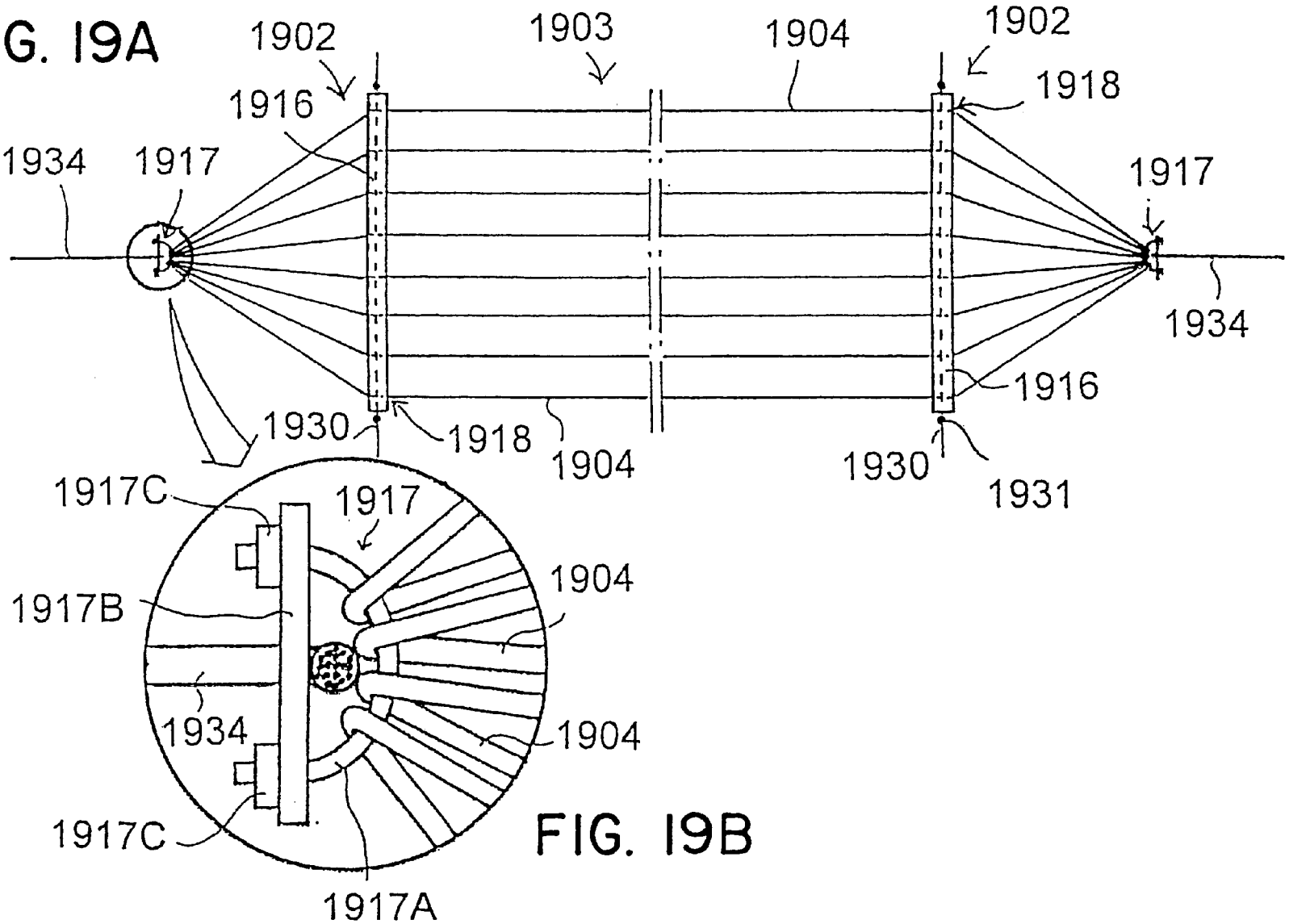
FIGS. 19A and 19B are a plan view showing a parallel line catcher and a partially expanded sectional view showing a connecting binder, respectively, according another embodiment of the safety apparatus for elevated work site operations of the present invention.

As shown in FIG. 19A, The space adjusting members 1916 are disposed at least at both ends of the parallel line catcher 1903 in order to suspend the plurality of the lines 1904 in horizontal fashion as the parallel line catchers 1903 are disposed in parallel.

The lines 1904 of parallel line catchers 1903 are connected by the ends of the lines 1904 to one another by a plurality of connecting binders 1917 which bind several lines 1904 into a single bundle at the outside of the space adjusting member 1916 to thereby suspend the lines 1904 in parallel at constant intervals. This makes it easy to suspend the parallel line catcher 1903 from a building or scaffoldings since it is easy to suspend a parallel line catcher 1903 by supporting it just from both sides of the catcher 1903. In other words, this will reduce the numbers of points to suspend. Furthermore, since it is unnecessary to suspend these lines 1904 individually in parallel, it is easy to handle them, such as by binding them to one line, and winding that line to a building or scaffolding.

When the transverse width of the parallel line catcher 1903 is approximately 50 cm or less, the connecting binder 1917 can bind all lines to one binder portion. When the transverse width of the parallel line catcher 1903 is approximately 1 m, the connecting binder 1917 can bind all lines 1904 to two portions. When the transverse of the parallel line catcher 1903 is wider than 1 m, the connecting binder 1917 binds all lines 1904 to several binder portions.

Any type of binder that can bind several lines and combine them together is usable as the connecting binder. For example, the connecting binder 1917, shown in FIGS. 19A and 19B, is a link-type. Additionally, this connecting binder 1917 as shown in the partially expanded sectional view of FIG. 19B comprises a U-shaped bolt 1917A having male screws at both ends, a clamp plate 1917B through which both ends of the U-shaped bolt 1917A are inserted, and nuts 1917C screwed to both ends of the U-shaped bolt 1917A. The connecting binder 1917 shown in FIG. 19B is used to bind the lines as follows: first, while the nuts 1917C are loose, several lines 4 and the binding cord 1934 are passed through the opening between the U-shaped bolt 1917A and the clamp plate 1917B; and second, the clamp plate 1917B is clamped by screwing the nuts 1917C further onto the bolt 1917A, whereby the connecting binder 1917 combines several lines 1904 and the binding cord 1934 to one portion bound. The connecting binder 1917 shown in FIG. 19B has the opening formed between the U-shaped bolt 1917A and the clamp plate 1917B, and binds the lines 1904 and the binding cord 1934 by screwing the nuts 1917C tighter so as to prevent loosening or slipping.

The plurality of lines 1904 having their opposing ends connected to the connecting binders 1917 may be replaced by one long line woven back and forth between a pair of the connecting binders 1917 located at both ends of the parallel line catcher 1903. Namely, the parallel line catcher comprises one continuous long line. This parallel line catcher comprises the long line by folding some intermediate points of line over and over at both ends of the parallel line catcher using the connecting binders 1917 and each binder 1917 binds these bent portions into a single bound bundle. This type of the parallel line catcher is configured by holding these bent portions bound by the connecting binder, and adjusting all the lengths of the partial lines, which is the length of the parallel line catcher, to the same length. These steps are easy and efficient for making the catchers because it is not necessary to cut the lines to the same length. In addition, it is also adjustable to allow the partial lines to be fitted to same length.

The lines 1904 bound by the connecting binders 1917 do not have to be connected to a building or scaffolding at each end of the lines 1904, respectively. Rather, all the lines 1904 are connected to a building or scaffolding by virtue of the binding cords 1934 being connected to the building or scaffolding. The parallel line catchers 1903 which are connected to a building or scaffolding by the connecting binders 1917 are suspended parallel and spaced apart at predetermined intervals by the space adjusting members 1916. The binding cords 1934 are attached to a building or scaffolding by a tension device, such as a turnbuckle (not illustrated), to extend as tight as possible. This allows for reducing looseness at intermediate portions of the parallel line catchers 1903. Consequently, the parallel line catchers 1903 which are disposed in that state are free from twisting of the lines 1904 or swinging in the wind which would disrupt work.

Furthermore, the safety apparatus having the space adjusting members 1916 are able to change the longitudinal length of the lines 1904 between the support members 1902, without adjusting the whole length of the lines 1904. In attaching the safety apparatus to a building, the length of the parallel line catcher 1903 is decided according to the size of the building. After extension of lines 1904 between the space adjusting members 1916, the extra portion of the lines 1904 are bound by the connecting binders 1917, such as by being connected to one another, wound themselves, or the like. By straining the bound ends of lines 1904 from outside of the support members 1902, the parallel line catchers 1903 are maintained horizontal and the extra length of the lines 1904 is therefore adjustable.

For example, a safety apparatus with parallel line catchers each having lines 10 m in length can be set for use with a building with a 10 m side, but it cannot be set for use with another building with an 8 m side because the lines are too long and 2 m of the length of the parallel line catcher is excess. The safety apparatus of the present invention with 10 m lines can have the length of the parallel line catchers adjusted by moving the space adjusting members along the lines. In this example, the safety apparatus can have the length of the parallel line catchers changed to 8 m and can be set for use with an 8 m side of the building. Since the extra 2 m portions of the lines need not be suspended parallel to one another, it is easy to adjust them, such as by binding them to one portion or winding them to the building or scaffolding.

Figure 24:
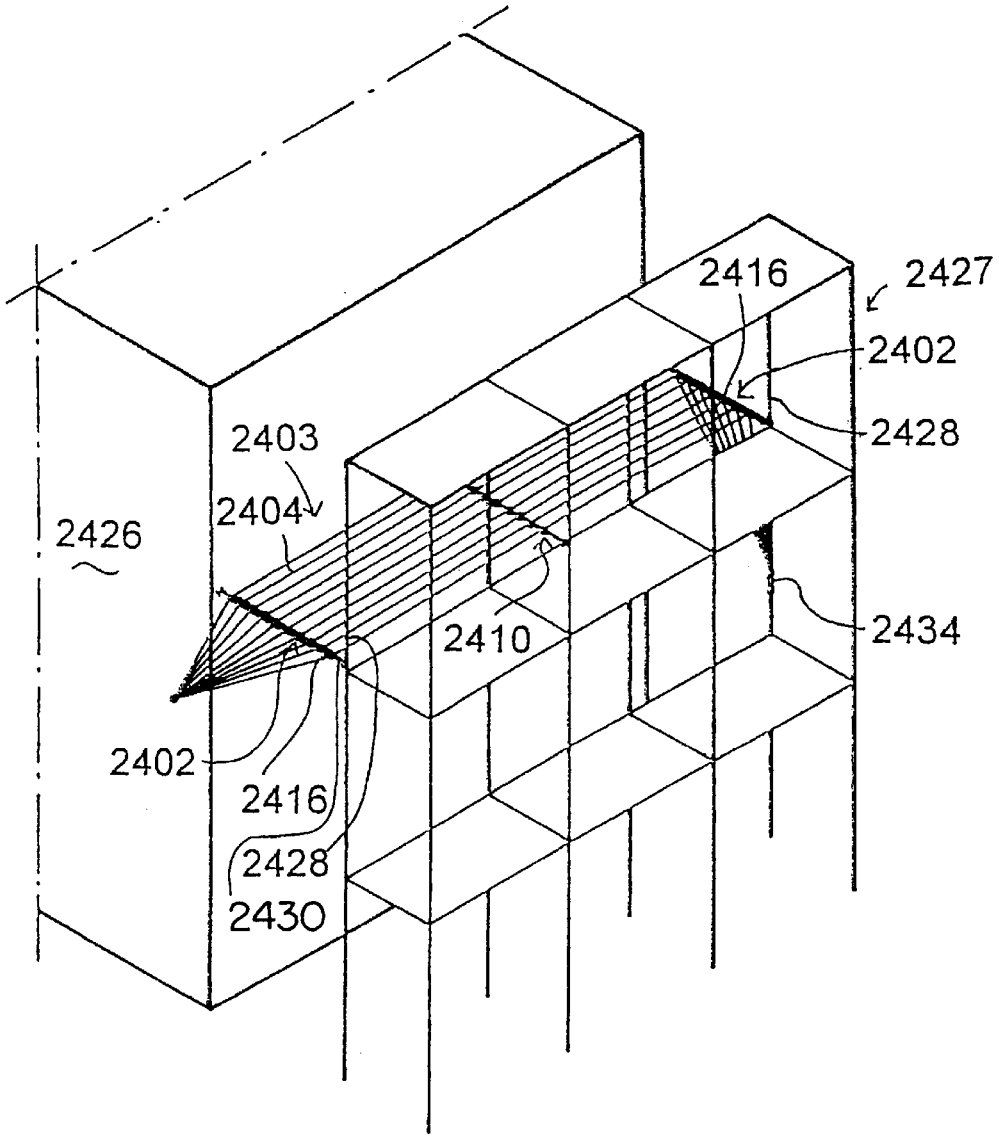
FIG. 24 is a perspective view showing use of another embodiment of the safety apparatus for elevated work site operations of the present invention.

The parallel line catcher as shown in FIG. 24 further comprises an elongated intermediate connecting member 2410 at an intermediate part thereof. The elongated intermediate connecting member 2410 maintains the lines 2404 at predetermined intervals in a horizontal fashion at intermediate portion of the lines 1904. The reason why the intermediate connecting member 2410 is placed at an intermediate portion is to prevent elongated spaces between the adjacent lines 2404 from widening at the intermediate portion of a long parallel line catcher 2403; otherwise, a falling worker might pass through the parallel line catcher 2403. Intermediate connecting members 2410 may be disposed at one or more points at intermediate portions of the lines 2404 depending upon the length of the parallel line catcher 2403. The width between the adjacent intermediate connecting members is, for example, more than 1 m, and preferably, more than 2 m so as to allow construction material to be placed therethrough by widening the space between the lines 2404.

The intermediate connecting member 2410 may be the same type of member as the elongated space adjusting member 2416. The intermediate connecting member 2410 will slide along the lines 2404 when a construction material, such as a board or window frame, must be through the parallel line catcher 2403. By moving the intermediate connecting member 2410, the elongated space between the adjacent lines 2404 can have its opening area enlarged by increasing the distance between adjacent intermediate connecting members 2410 or between the intermediate connecting member 2410 and the space adjusting member 2416. Furthermore, since the intermediate connecting member 2410 is movable along the lines 2404, construction materials can be passed through the lines 2404 by widening a transverse distance between the adjacent lines 2404 easily.

In addition, as shown in FIG. 24, the intermediate connecting member 2410 also prevents the parallel line catcher 2403 from rolling by connecting the ends of the intermediate connecting member 2410 to a building, such as a bridge portion of the building 2426 or scaffolding 2427. The intermediate connecting member 2410 which has both of its ends connected to the building 2426 or scaffolding 2427, when the parallel line catcher catches a falling object, can stop swinging, or rolling of the parallel line catcher 2403, thus effectively preventing the falling object from falling from the side of the parallel line catcher. Therefore by using the intermediate connecting member 2410 connected at both ends to the building 2426 or scaffolding 2427, the non-rolling parallel line catcher 2403 can catch a falling object safely and surely. Furthermore, this intermediate connecting member 2410 prevents its center portion from sagging much under its own weight. Consequently, this type of parallel line catcher 2403 has an advantage that the supporting force required at both ends of the parallel line catcher 2403 is somewhat reduced. Additionally, the parallel line catcher 2403 with less sagging undergoes less swinging due to wind and less tangling of lines 2403, and thus poses less interruption for workers. The intermediate connecting member 2410 connected to a building 2426 or scaffolding 2427 can slide along the lines 2404 by releasing its connection to the building.

FIG. 24 shows the actual use of the safety apparatus using parallel line catchers for elevated work site operations according to present invention. The apparatus as shown in FIG. 24 has the parallel line catcher 2403 extended in parallel to the building by attaching the ends of the space adjusting members 2416 to the building 2426 and scaffoldings 2427. The scaffoldings 2427 are assembled vertically, for example, at a distance of approximately 50 cm from the building 2426. The space adjusting members 2416 are attached to the scaffoldings 2427, or the walls and columns of the building 2426 for disposing parallel line catchers 2403 in the gaps between the scaffold 2427 and the building 2426.

Concerning the space adjusting members 2416 as shown in FIG. 24, the ends of the back-up connecting cord 2430 are connected to the scaffoldings 2427 and the walls or 2428 of the building 2426 (or, although not illustrated, to the ends thereof of adjacent back-up connecting cords) so as to extend the parallel line catchers 2403 in parallel and prevent them from rolling. The space adjusting members have chain links connected at their ends, and be attached to the scaffoldings or the walls and columns of the building by these links (not illustrated).

As shown in FIG. 24, the space adjusting members 2416 disposed between the building 2426 and scaffoldings 2427 extend the elongated parallel lines 2404 so as to be spaced part at predetermined intervals and thus position the parallel line catcher 2403. In that situation, the parallel line catcher 2403 is extended parallel because the ends are suspended outwardly or downwardly, the slack at the center portion of the lines 2404 is therefore reduced. Since the suspended ends of binding cords 2434 are secured to the building 2426 or scaffoldings 2427, the extended parallel line catcher 2403 holds its parallel state even at its center portion. Thus, the parallel line catcher 2403 has the characteristic that it can be extended in parallel regardless of the positions at which the support members 2402 are fixed; in other words, even the interval between the support members 2402 can be changed and the length of the extension of the parallel line catcher 2403 can vary.

Figure 25:
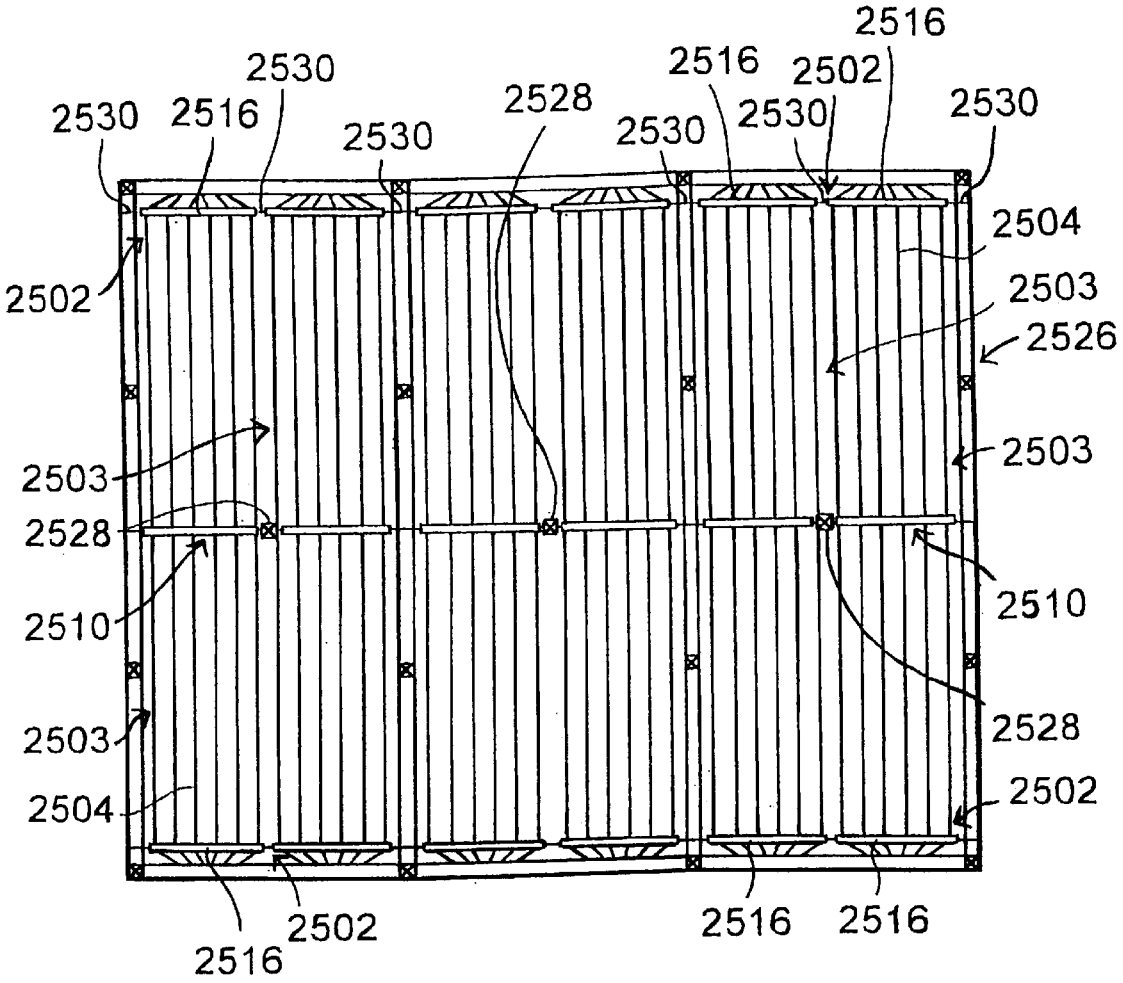
FIG. 25 is a plan view showing another use of an embodiment of the safety apparatus of the present invention.

The above embodiments describe suspension of the safety apparatus of the present invention around buildings. However, the safety apparatus of the present invention as shown in FIG. 25, is also applicable to a parallel line catcher 2503 that is suspended over the entire area inside a building 2526 where there is no floor, at a construction site. The safety apparatus of this FIG. 25 will safely catch workers who fall in the interior of the building 2526. The parallel line catcher 2503 of the safety apparatus as shown in FIG. 25 is extended parallel, close to and below a girder supporting a floor, or close to and below a girder supporting a roof. This type of safety apparatus includes a plurality of the parallel line catchers 2503 parallel to one another along the transverse direction, each parallel line catcher 2503 being connected to the adjacent pair of the parallel line catchers 2503 and extending parallel to each other along their longitudinal directions. In particular, transversely adjacent pairs of the space adjusting members 2516 are connected to each other, and transversely adjacent pairs of the intermediate connecting members 2510 are connected to each other in line. The supporting members 2502 which support the elongated lines 2504 comprise the space adjusting members 2516. The adjacent pairs of the space adjusting members 2516 are connected parallel to each other by tying the adjacent back-up connecting cords 2530. Where the intermediate connecting members 2510 have back-up connecting cords 2530, they connect to one another by tying or connecting the facing ends of the cords 2530, respectively. The back-up connecting cords 2530 may also be connected to a wall of the building 2526 or scaffolding 2527. This type of safety apparatus can effectively prevent workers from falling through a wide opening area such as an opening of a building 2526 or just the frame of a building. Furthermore, as shown in FIG. 25, even when there are some columns 2528 inside of a building, a plurality of parallel line catchers 2503 can be disposed and extended by positioning the columns 2528 at the boundary parts between adjacent catchers 2503 so that the columns 2528 do not interfere.

By the way, the safety apparatus for elevated work site operations of the present invention is not restricted to construction work applications. For example, although not illustrated, parallel line catchers can be suspended around utility poles to improve utility pole work safety, parallel line catchers can be suspended adjacent to bridges to improve bridge construction safety, and parallel line catchers can be suspended at civil engineering elevated construction sites to improve safety.

As the present invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims or equivalence of such metes and bounds thereof are therefore intended to be embraced by the claims.

I claim:

1. A safety apparatus for use in elevated work site operations, said safety apparatus comprising:

a plurality of elongated lines respectively having elongated catcher portions extending substantially parallel to one another in a longitudinal direction;

a pair of spaced-apart support members elongated in a transverse direction substantially perpendicular to said longitudinal direction and supporting said elongated lines such that said elongated catcher portions are held in a generally horizontal orientation with said elongated catcher portions spaced apart from one another in the transverse direction so as to form longitudinally elongated spaces between adjacent pairs of said elongated catcher portions, respectively;

an elongated back-up connecting cord extending through each of said support members in said transverse direction;

wherein each of said longitudinally elongated spaces is free of obstructions, which could block passage of materials therethrough, over a longitudinal distance substantially greater than a transverse distance between each adjacent pair of said elongated catcher portions; and wherein each of said support members is rigid in the transverse direction over a distance spanning said plurality of elongated catcher portions, so as to maintain spacing between each adjacent pair of said elongated catcher portions;

whereby said safety apparatus can catch falling objects yet allow construction objects to be passed therethrough.

2. A safety apparatus as recited in claim 1, wherein nodes are formed along said elongated back-up connecting cords adjacent opposing ends of the respective support member, so as to maintain relative positioning of the support members along said elongated back-up connecting cords, respectively.

3. A safety apparatus as recited in claim 1, wherein each of said support members comprises a lower side rod, and an upper side rod removably secured to said lower side rod.

4. A safety apparatus as recited in claim 3, wherein for each of said support members, each of said upper side rod and said lower side rod is U-shaped so as to have two opposing side edges, at least one of said upper side rod and said lower side rod has an elongated ditch extending along one of said opposing side edges, and at least the other of said upper side rod and said lower side rod has one of its opposing side edges removably mounted in said elongated ditch of said at least one of said upper side rod and said lower side rod.

5. A safety apparatus as recited in claim 4, wherein nodes are formed along said elongated back-up connecting cords adjacent opposing ends of the respective support member, so as to maintain relative positioning of the support members along said elongated back-up connecting cords, respectively.

* * * * *